United States Patent [19]

Jäger

[11] 4,120,447

[45] Oct. 17, 1978

[54] PRESSURE-TIGHT SOLID BOWL SCREW CENTRIFUGE

[75] Inventor: Ernst Adolf Jäger, Vilsbiburg, Germany

[73] Assignee: Flottweg-Werk Dr. Georg Bruckmayer GmbH & Co. KG, Germany

[21] Appl. No.: 735,903

[22] Filed: Oct. 26, 1976

[30] Foreign Application Priority Data

Oct. 23, 1975 [DE] Fed. Rep. of Germany ..... 2547538

[51] Int. Cl.[2] ..... B04B 3/04; B04B 9/06

[52] U.S. Cl. ..... 233/7; 233/24

[58] Field of Search ..... 233/7, 23 R, 24, 25; 417/423 R, 423 A; 418/82, 206

[56] References Cited

U.S. PATENT DOCUMENTS

| | | | |
|---|---|---|---|
| 1,824,722 | 9/1931 | Jones | 233/23 R |
| 2,726,807 | 12/1955 | Lewis | 417/423 A |
| 2,743,865 | 5/1956 | Graae | 233/7 |
| 2,927,669 | 3/1960 | Walerowski | 418/82 X |
| 3,061,181 | 10/1962 | Gooch | 233/7 |
| 3,228,592 | 1/1966 | Shapiro | 233/7 |
| 3,428,247 | 2/1969 | Andresen et al. | 233/7 |
| 3,734,399 | 5/1973 | Oas | 233/7 |
| 3,923,241 | 12/1975 | Cyphelly | 233/7 |

FOREIGN PATENT DOCUMENTS

| | | | |
|---|---|---|---|
| 2,528,927 | 8/1976 | Fed. Rep. of Germany | 418/206 |

*Primary Examiner*—George H. Krizmanich
*Attorney, Agent, or Firm*—Craig & Antonelli

[57] ABSTRACT

A pressure-tight solid jacket or bowl screw-type centrifuge arrangement which includes a centrifuge bowl and a screw rotatably arranged in the centrifuge bowl. Drive equipment is provided for driving the centrifuge bowl and the screw with a housing being provided for accommodating and enclosing the centrifuge bowl and the drive equipment in a pressure-tight manner.

11 Claims, 2 Drawing Figures

PRESSURE-TIGHT SOLID BOWL SCREW CENTRIFUGE

Figure 1:
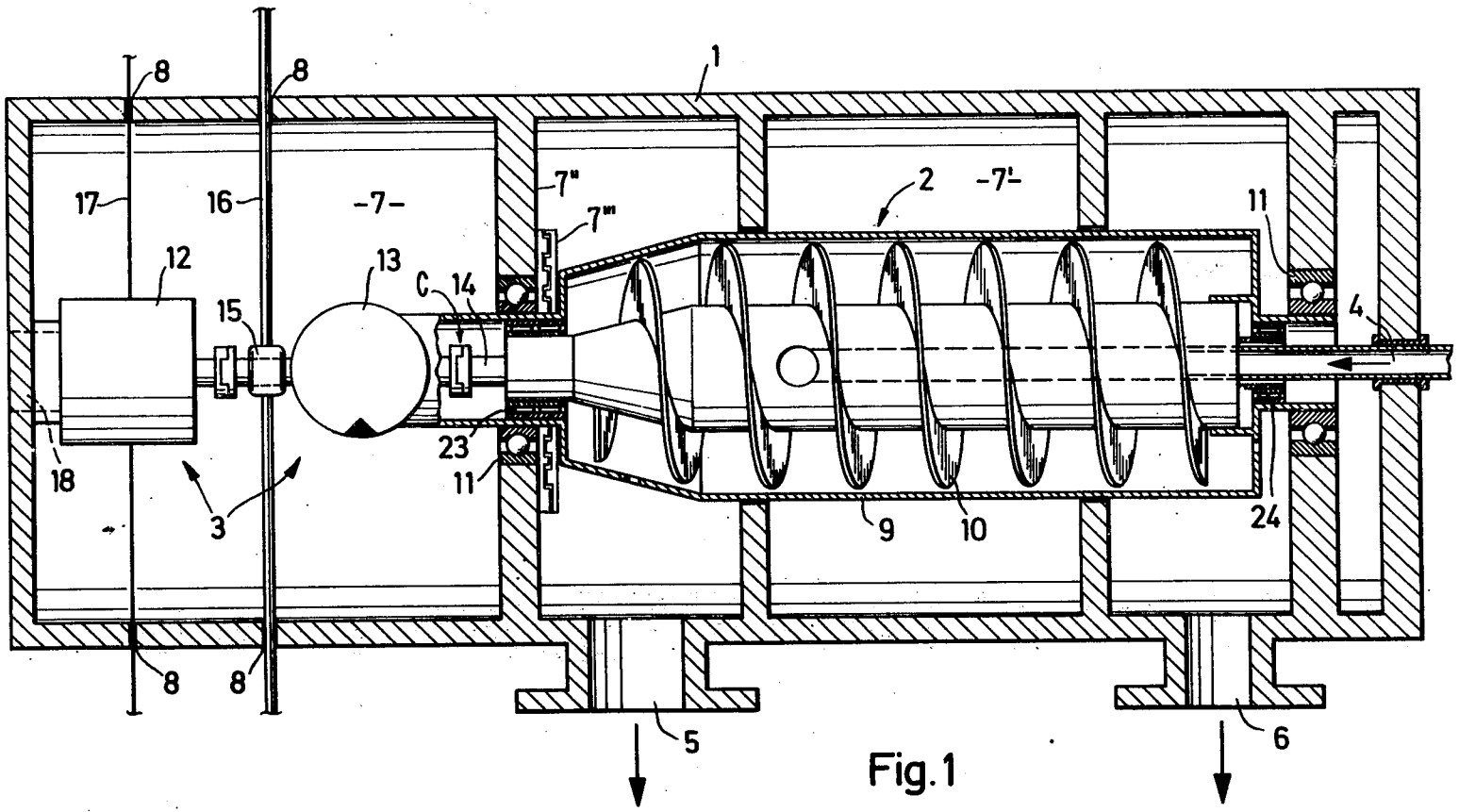

The present invention relates to a centrifuge arrangement and, more particularly, to a pressure-tight solid bowl or jacket screw centrifuge which includes a housing containing a centrifuge bowl and a suspension inlet and discharge for discharging separated products in a pressure-tight manner.

In contrast to pressure-tight or gas-tight machines which achieve sealing with a labyrinth packing to maintain a small pressure difference between the interior and exterior of the machines, in proposed pressure-tight solid bowl screw centrifuges, very expensive slide ring packings are required in order to seal the transition point between the pressure-tight housing surrounding the centrifuge bowl and the drive shafts for the centrifuge bowl and the screw.

Additionally, the special requirements on operational safety, such as those necessary, for example, in the chemical field of application, are not the least factor in substantially pushing up the manufacturing and maintenance costs for proposed slide ring packings. However, even with such slide ring packings, at pressures of a few atmospheres, the limits of the range of use of the centrifuge are reached.

To provide for the passage of fixed devices through the housing for supplying the suspension to be separated, for discharging the solids and the clear liquid, and/or for the draining off of the liquid phases, lock devices are provided and arranged so as to permit higher operating pressures. However, such lock devices are inapplicable to the transition point between the pressure-tight housing surrounding the centrifuge bowl and the drive shafts for the centrifuge bowl and the screw.

The present invention is concerned with the task to provide a pressure-tight solid bowl screw centrifuge which can operate at far less expense and with greater operational safety at higher working pressures while eliminating the afore-mentioned shortcomings.

The underlying problems are solved in accordance with the present invention by providing a pressure-tight solid bowl screw centrifuge wherein the housing extends beyond the centrifuge bowl at the driving end and encloses the drive equipment which engages the drive shafts in a pressure-tight manner.

In accordance with one feature of the present invention, the power supply or driving medium connections for the drive equipment of the centrifuge and, if desired, coolant channels which do not carry out any relative movement with respect to the housing are arranged through at least one wall of the housing with the passages for these respective elements being sealed in a pressure-tight manner, relative to the inside of the housing. As can be readily appreciated, the sealing of the connection or coolant channels can be effected by suitable less expensive sealing means than seals such as would be required between the centrifuge and the drive device so as to maintain pressure-tight relationships in the region of the drive shaft arrangement, that is, in the region of parts of the centrifuge which move relative to one another during operation of the same.

In accordance with another feature of the present invention ducts or the like are formed directly on the housing with the ducts being welded to the wall of the housing connected by way of a flanged connection between which flanges packings may be introduced which can readily be designed for virtually any operational pressure.

By virtue of the provision of ducts or flanged connections, previously employed expensive and sensitive slide ring packings used for sealing the transition area between the moving parts of the centrifuge can be dispensed with since sealing need only be effected between parts which do not move relative to one another.

For driving the centrifuge bowl and the screw, according to the present invention, a common drive motor may be provided which drives the centrifuge bowl with a gear having a constant step-up or step-down ratio being interposed between the centrifuge bowl and the screw.

It is also possible in accordance with the present invention to provide separate drive motors for the centrifuge bowl and the screw with the motors being matched to one another with respect to their rates of revolution.

Additionally, in accordance with the present invention, the drive equipment may be constructed so that a common drive motor drives the centrifuge bowl and the screw with a second motor rather than a gear being interposed between the screw and the centrifuge bowl with the speed of rotation of the second motor directly determining the differential speed between the centrifuge bowl and the screw.

The drive motor or motors may be constructed as electric motors, the heat of which resulting from energy losses could be removed by a fan device of the motor, that is, by cooling air. Thus, it would also be possible to enhance such cooling by ensuring that, inside the pressure-tight chamber, there is a circulation of gas or air which, if necessary, would be passed through a cooling unit such as, for example, a heat exchanger.

In situations wherein, for any reason, the gaseous medium inside the pressure chamber of the centrifuge could not be used as a coolant for the drive equipment, it is possible in accordance with the present invention to construct a cooling air channel whicH supplies air taken in from outside the housing to a fan device or to the motor which is to be cooled with the cooling air being exhausted through another channel. By virtue of the fact that the housing in accordance with the present invention encloses the centrifuge and drive equipment, it is readily possible to ensure that the exhaust channel and the cooling air inlet channel within the motor are entirely sealed off in a pressure-tight manner from a pressurized inner chamber of the housing. In this connection, motors having an independent air cooling are used, the interior of which is penetrated by cooling air pipes, said pipes being sealed in a pressure-tight manner from the interior of the motor. Such a motor is disclosed, for example, in "AEG-Hilfsbuch," 7th edition, page 506, Bild 22, by omitting the outer right blower and connecting the pipes in a pressure-tight manner — e.g. by welding — with channels, which are welded in a pressure-tight manner with the walls of the motor casing and guided through the wall of the centrifuge housing in a pressure-tight manner and which channels are connected to a blower arranged outside the centrifuge housing.

To compensate for differential oscillations between the housing and the motor or the drive device, in accordance with the present invention, the inlet and exhaust channels can be made correspondingly flexible in construction, for example, by having a curved path or a corresponding flexible construction reinforced against external pressures, but with a shorter channel length. One can also effect the cooling directly, taking care of the fact that only the stator of the motor is be cooled, and the stator cooling chamber is be sealed off in a pressure-tight manner from the rotor and hence from the bearings so as not to shift the sealing problem from the proposed slide ring packing to the shaft duct of the drive motor.

In the event a cooling system of the above-mentioned type is not adequate or if the centrifuge is working with correspondingly high operational pressures, it is possible in accordance with the present invention to provide a pressurized cooling air circulation for the electric motor with the pressure of the cooling air being under a pressure which is substantially higher than the operational pressure of the centrifuge.

In accordance with one embodiment of the present invention, the inside of the housing is divided into a first chamber for receiving the centrifuge bowl and a second chamber for receiving the drive equipment with a partition being arranged between the two chambers. The partition may be constructed as a wall member or, for example, a labyrinth packing so that a slightly higher pressure can be created in the chamber receiving the drive equipment than the operational pressure of the centrifuge prevailing in the chamber receiving the centrifuge bowl. By virtue of this arrangement, a specific flow occurs from the chamber receiving the drive equipment into the chamber receiving the centrifuge bowl and, as a result, the chamber receiving the drive equipment can, to some extent, be isolated atmospherically from the chamber receiving the centrifuge bowl. Also, it is possible to receive the chamber accommodating the drive equipment in a cooling air circuit.

While the above cooling arrangements have been described, it is understood that other separate cooling systems are possible, which may be arranged in or around the housing of the centrifuge in the manner described hereinabove.

In accordance with a further embodiment of the present invention, the centrifuge bowl is equipped with drive equipment which operates with motors driven by pressure media, for example, hydraulic or oil motors. The utilization of hydraulic motors has the advantage that the pressure medium supplying the driving energy may simultaneously serve as a coolant. The supply of pressure medium to the hydraulic motor is effected by means of a so-called rotary duct which conveys the pressure medium from the stationary pressure lines to a rotating part of the motor. It is possible to construct such rotary ducts so that they withstand the operating pressure of the pressure liquid without any appreciable losses. Additionally, the operating pressure of the centrifuge which acts upon the rotary duct from outside additionally opposes the escape of pressure medium.

The utilization of hydraulic motors has the particular advantage that standard manufactured parts can be employed, whereas due to attendant cooling problems in other drive motors, it is more or less essential to provide special constructions for cooling, thereby resulting in a corresponding increase in manufacturing costs.

While electric motors and hydraulic motors may be employed as the drive equipment, it is also possible in accordance with the present invention to provide drive equipment of mixed construction, that is, with drive units of the type which operate with different energy carriers.

Accordingly, it is an object of the present invention to provide a pressure-tight solid bowl screw centrifuge which avoids by simple means the afore-mentioned drawbacks and shortcomings encountered in the prior art.

Another object of the present invention resides in providing a pressure-tight solid bowl screw centrifuge which is relatively simple in construction and therefor also relatively inexpensive.

Yet another object of the present invention resides in providing a pressure-tight solid bowl screw centrifuge which can operate with greater operational safety at higher operating pressures.

A further object of the present invention resides in providing a pressure-tight solid bowl screw centrifuge which ensures proper and adequate cooling of the drive equipment.

A still further object of the present invention resides in providing a pressure-tight solid bowl screw centrifuge which minimizes failures or breakdowns due to leaks in the system.

Figure 2:
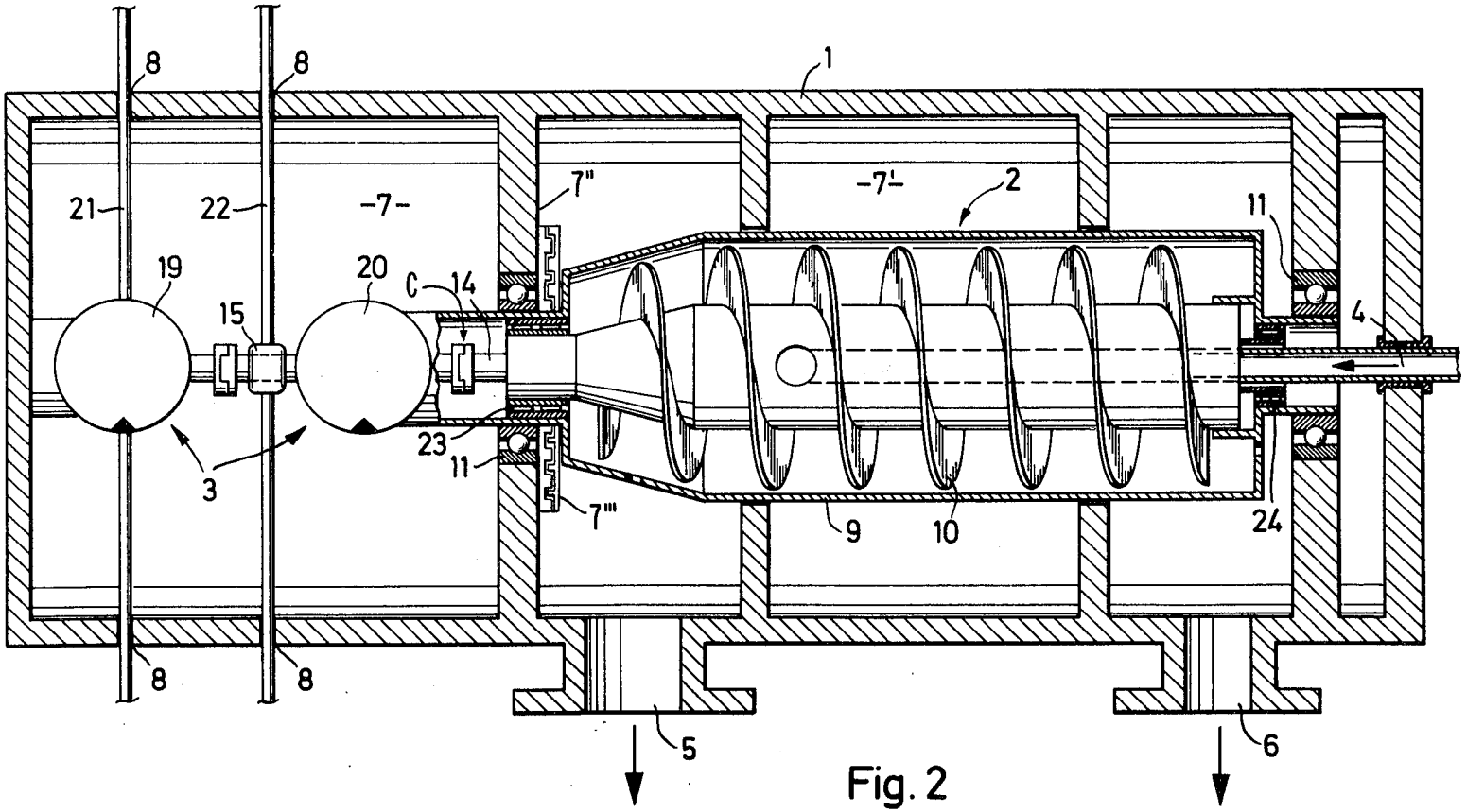

These and other objects, features and advantages of the present invention will become more apparent from the following description when taken in connection with the accompanying drawings, which show, for the purposes of illustration only, two embodiments of a pressure-tight solid bowl screw centrifuge in accordance with the present invention, and wherein:

FIG. 1 is a longitudinal partial cross-sectional view of a first embodiment of a pressure-tight solid bowl centrifuge in accordance with the present invention, and FIG. 2 is a longitudinal partial cross-sectional view of a second embodiment of a pressure-tight solid bowl centrifuge in accordance with the present invention.

Referring now to the drawings wherein like reference numerals are used through both views and, more particularly, to FIG. 1, according to this figure, a housing 1 encloses, in a pressure-tight manner, an entire centrifuge generally designated by the reference numeral 2, associated drive equipment generally designated by the reference numeral 3, an inlet 4 provided for supplying the suspension to be separated, a solids discharge 5 and a clear liquid discharge 6. Lock devices (not shown) are provided at the inlet and discharges 4, 5, 6, respectively, which permit the interior of the housing 1 to be put under constant high pressure. The housing 1 is divided into at least first and second chambers 7', 7, respectively, by a partition wall 7'' and/or a labyrinth packing 7''' with the first chamber 7' accommodating a centrifuge bowl 9 and the second chamber 7 accommodating the drive equipment 3. The provision of the partition wall 7'' and/or the labyrinth packing 7''' permits the creation of a somewhat higher pressure in the second chamber 7 than in the first chamber 7'.

Apertures 8 are provided in the housing 1 in the area of the drive equipment 3 and may be fashioned as ducts or the like for accommodating lines which do not carry out any relative movement with respect to the housing 1. To avoid any leaks and to maintain the housing pressure-tight, conventional seals (not shown) may be arranged at the respective apertures 8.

The centrifuge bowl 9 is arranged in the housing 1 and has mounted therein a screw 10 with the centrifuge bowl 9 being supported in the housing 1 at both ends by suitable bearings 11. The screw 10 is mounted on the centrifuge bowl 9 in the vicinity of its drive shaft by way of a front screw bearing 23 at one end and by way of a rear screw bearing 24 at the end adjacent the suspension inlet 4 in a conventional manner only shown diagrammatically in the drawing.

The drive equipment 3 includes a drive motor 12 and a drive unit 13 interposed between the centrifuge bowl 9 and a drive shaft 14 of the screw 10. The drive unit 13 may be formed as a gear having a constant step-up or step-down ratio which, at the driving end, is fixed on the centrifuge bowl 9 driven by the drive motor 12 and at the driven end on the drive shaft 14 of the screw 10.

The drive unit 13 may also be constructed as a motor, the casing of which is flanged onto the centrifuge bowl 9 and the shaft of which is secured or operatively connected to the drive shaft 14 of the screw 10 by a conventional coupling means generally designated by the reference character C. The rate of revolution of the motor would then directly determine the differential speed between the centrifuge bowl 9 and the screw 10 independently of the rate of revolution of the centrifuge bowl 9.

In the embodiment of FIG. 1, the drive unit 13 is constructed as a pressure medium motor which includes a schematically indicated rotary duct 15 which is fed by a pressure medium line 16.

The drive motor 12 may be constructed as an electric motor which is energized by way of wire leads 17 with an opening or channel 18, shown in phantom line, being provided in the end wall of the housing 1 at the driving end for air cooling of the drive motor 12. In the illustrated construction, only the stator of the electric drive motor 12 is cooled while the rotor, together with its bearings, is sealed off in a pressure-tight manner from a chamber (not shown) accommodating the stator. By a corresponding division of the stator chamber into channels (not shown) extending coaxially to the rotor axis, the cooling air is blown in through a number of the channels and escapes again through a different set of channels (not shown). The channels of the stator chamber, sealed off in a pressure-tight manner from the rotor chamber, communicate with the opening or channel 18 in the housing 1.

As shown in FIG. 2, the drive equipment generally designated by the reference numeral 3 includes exclusively hydraulic or oil motors 19, 20 with the oil motor 19 driving the centrifuge bowl 9 and the casing screw of the other oil motor 20, the driven part of which is connected to the screw 10. The drive motor 19 is fixedly positioned with regard to its casing and, thus, as in the arrangement of FIG. 1, drives the centrifuge bowl 9 directly and drives the screw 10 by way of the differential speed supplied by the oil motor 20. The motors 19 and 20 are supplied with pressure medium by way of corresponding oil pressure lines 21 and 22, respectively, with the oil flowing in said lines simultaneously serving to remove the heat resulting from energy losses of the motors. In this way, no special measures are required in the motors 19, 20 to permit operation inside the pressure-tight sealed housing 1. Such an arrangement of oil motors is described, for example, in the U.S. Pat. No. 3,923,241. Oil motors as such are known in principle, e.g. from "LUEGER," Lexikon der Technik, 4th edition, vol. 8, pages 460 through 462.

While I have shown and described only two embodiments in accordance with the present invention, it is understood that the same is not limited thereto, but is susceptible of numerous changes and modifications as known to those skilled in the art, and I therefor do not wish to be limited to the details shown and described herein, but intend to cover all such changes and modifications as are encompassed by the scope of the appended claims.

I claim:

1. A centrifuge arrangement comprising:
a centrifuge bowl,
a screw rotatably arranged in the centrifuge bowl,
drive motor means for driving said centrifuge bowl and said screw,
a housing means for completely enclosing said centrifuge bowl and said drive motor means in a pressure-tight manner, and
means provided at said housing means for enabling a creation of a higher pressure in an area surrounding the drive motor means than in an area surrounding the centrifuge bowl.

2. An arrangement according to claim 1, wherein means are provided for cooling said drive motor means.

3. An arrangement according to claim 2, wherein said cooling means includes at least one channel means arranged in a pressure-tight manner in said housing means for directing the flow of a coolant on said drive motor means.

4. An arrangement according to claim 1, wherein said drive motor means includes a pressure medium-operated drive motor and wherein means are provided for operatively connecting said pressure medium-operated drive motor to at least said screw.

5. An arrangement according to claim 4, wherein said pressure medium-operated drive motor is an oil motor.

6. An arrangement according to claim 1, wherein said drive motor means includes a first drive motor operatively connected with said centrifuge bowl for driving the same, and a second drive motor interposed between said centrifuge bowl and said screw for driving said screw by way of a differential speed supplied by said second drive motor.

7. An arrangement according to claim 6, wherein said first and second drive motors are pressure medium-operated drive motors.

8. An arrangement according to claim 7, wherein said pressure medium-operated motors are oil motors.

9. An arrangement according to claim 6, wherein one of said first and second drive motors is an electric motor and the other of said drive motors is a pressure medium-operated motor.

10. A centrifuge arrangement comprising:
a centrifuge bowl,
a screw rotatably arranged in the centrifuge bowl,
drive means for driving said centrifuge bowl and said screw,
a housing means for enclosing said centrifuge bowl and said drive means in a pressure-tight manner, including a first chamber means for accommodating the centrifuge bowl and a second chamber means for accommodating the drive means, and
means for separating said first chamber means from said second chamber means in such a manner that a somewhat higher pressure can be created in the second chamber means than in said first chamber means.

11. An arrangement according to claim 10, wherein said means for separating said first chamber means from said second chamber means includes a labyrinth packing means aranged between said first and said second chamber means.

* * * * *